United States Patent [19]

Bechstein

[11] Patent Number: 4,553,365

[45] Date of Patent: Nov. 19, 1985

[54] SUPPORT SYSTEM FOR CEILING AND WALL PANELS

[75] Inventor: Bradley L. Bechstein, Toledo, Ohio

[73] Assignee: Tibbet Incorporated, Toledo, Ohio

[21] Appl. No.: 537,523

[22] Filed: Sep. 30, 1983

[51] Int. Cl.[4] ..... E04B 5/52

[52] U.S. Cl. ..... 52/483; 52/489

[58] Field of Search ..... 52/241, 483, 484–486, 52/489, 476, 506, 509, 511, 745, 714

[56] References Cited

U.S. PATENT DOCUMENTS

| | | | |
|---|---|---|---|
| 1,861,615 | 6/1932 | Venzie | 52/484 |
| 1,863,565 | 6/1932 | Davis et al. | 52/484 |
| 2,074,442 | 3/1937 | Venzie | 52/486 |
| 2,242,558 | 5/1941 | Venzie | 52/486 |
| 2,968,850 | 6/1961 | Tinnerman | 52/39 |
| 2,994,113 | 8/1961 | Dail | 52/779 |
| 3,852,927 | 12/1974 | Birum | 52/483 |
| 4,089,146 | 5/1978 | Martinez | 52/484 |
| 4,215,765 | 8/1980 | Harris | 52/144 |
| 4,245,446 | 1/1981 | Judkins | 52/1 |
| 4,438,613 | 3/1984 | Hintsa et al. | 52/489 |

*Primary Examiner*—James L. Ridgill, Jr.
*Attorney, Agent, or Firm*—Charles F. Schroeder

[57] ABSTRACT

A ceiling panel support system in which framed panels are supported by slideable generally "U" shaped brackets at opposite sides of each panel, one leg of each bracket being generally hook-shaped to provide an undersupport for one edge of the panel by engagement with an overhanging portion of the frame extending above the panel and the other leg being arranged to make interlocking engagement with clips slideable in a track at the edge of the frame of an adjacent panel, the clips being moveably positioned on the frame of an adjacent panel for snap supporting engagement thereof. A panel is installed in the system by first hanging the panel vertically from two or more brackets aligned along the edge of the position in which it is to be installed whereupon it can be pivotally swung into installed position in clip-snapped engagement with brackets aligned above the opposite edge of the panel. In addition, the system allows support of panels in any of a wide range of orientations from vertical to horizontal.

7 Claims, 4 Drawing Figures

SUPPORT SYSTEM FOR CEILING AND WALL PANELS

The present invention relates to an improved support system for ceiling, wall and divider panels and more particularly to framed or rigid panels which according to the invention are made supportable in a wide range of orientations from positions in a selectable horizontal level to positions in a vertical plane as well as in inclined positions between.

Prior art contemporary support systems for ceiling panels have predominantly been reliant on grid supports made up of members such as T or C-channel members, which are either hung by wire, cables or rods at a level below an overlying ceiling or structural supports, or are secured directly to such overlying structural support members. Disadvantages of such support systems, however, are that the panels or tiles are most often not easily positionable at a desired level or in a given location within such level, but are limited in their location by structural members of the supporting grid system.

An object of the invention is to provide a support arrangement for ceiling and wall panels which enables easy installation of the panels in any desired location in a ceiling without being limited by structural members of the overlying support system.

Another object of the invention is to provide a panel supporting arrangement which establishes an aligned relationship between adjacent panels such that possibilities of misalignment are minimal.

A further object of the invention is to provide a ceiling panel supporting system which provides positive support of panels yet allows easy alignment in any of a wide range of length and width locations in the ceiling.

Still another object of the invention is to provide a support system which imparts a positive support of panels and which is additionally readily adaptable to emergency safety support against danger of disengagement and dropping of panels.

These objectives are attained in the system of the present invention by providing positionable panel support brackets which can be conveniently slid into a desired location on the overlying support grid system as well as by making it possible for the support brackets to make supporting engagement with the panels in any position along the frame of the panel. Thus, individual panels can be located anywhere desired in the system. The bracket which makes this possible is a generally "U" shaped member having one leg which engages one edge of a panel in hook-like fashion to permit it to be hung along the one edge for a pivotal movement into a horizontal position. The opposite legs of identical brackets aligned along the opposite edge of the panel each provide a tongue-like supporting end which engage clip members slideably positionable at the opposite panel edge. The two legs of each bracket are thus arranged to engage panel edges differently, one leg being designed to engage the edges in under supporting relation and the other in snapped overlying relation. Each bracket thus lends itself to engaging opposite edges of adjacent panels in the system. The spacing of the legs thus is made such that adjacent abutting panels in the ceiling are held in fixed abutting association with very little or no possibility of misalignment.

Another feature of the invention is the ease of installation of panels and the assurance of their positive alignment and positive support. In addition, the fixed spacing between supporting legs of the brackets prevents lateral dislodgment between adjacent abutting panels and minimizes the possibility of removal of panels without knowledge of how they should be removed.

Still another feature of the invention is its adaptability to support of panels for accoustical and thermal properties as well as panels having a wide range of decorative effects.

A further feature is that the bracket of the invention provides an interlocked relation between abutting panels in fixed spaced relation to assure positive desired alignment of panels in the system.

A still further feature of the invention is the ease of installation of the support brackets as well as their positive concealed support of panels by engagement with overhanging frame ledge portions.

The bracket of the invention is a generally "U" shaped member, one leg of which is arranged to provide an underhanging lip which engages an overlying ledge of a panel to be supported whereby the panel can be hung with a vertical orientation for pivotal or swinging movement into a horizontal installed position. The fact that the panels can be hung from the bracket promotes ease in installation in that all an installer need do to install a panel is to hang it in a position adjacent to the location where it is to be installed and then move the panel upward about the edge from which it is hung until one or more supporting clips at the opposite edge make snap engagement with brackets correspondingly aligned above the opposite edge of the panel. A full ceiling is thus installed by hanging and pivotally moving each panel in turn into engaged association with a set of brackets which already support panels in an adjacent row. Panel clips which the bracket legs engage to support the panels are made slideably positionable in a groove or recessed track along the top edge of th panel frame. The brackets are correspondingly made slideably positionable along the longitudinal members of an overlying supporting grid structure. Thus the panel supports can be provided in any of a wide range of positions on both sides of panels to provide solid support for the weight of panels installed.

Although the terminology "framed panels" or "tiles" as used herein refers to panel units having frames of metal such as aluminum extruded to desired cross-sectional configuration, the frames may also be made of any of a number of materials, adaptable to shaping and in this regard might be made of materials such as synthetic plastic or wood and other metals such as brass and steel. Further in this regard, the body of the panels or tiles may be made of material adaptable to providing a rigid edge with a desired contour or may be made of rigid material throughout.

The novel features which I believe to be characteristics of my invention are set forth with particularity in the amended claims. My invention, however, both as to its organization and method, together with further objects and advantages thereof may be best understood by reference to the following description taken in connection with the accompanying drawing in which:

Figure 1:
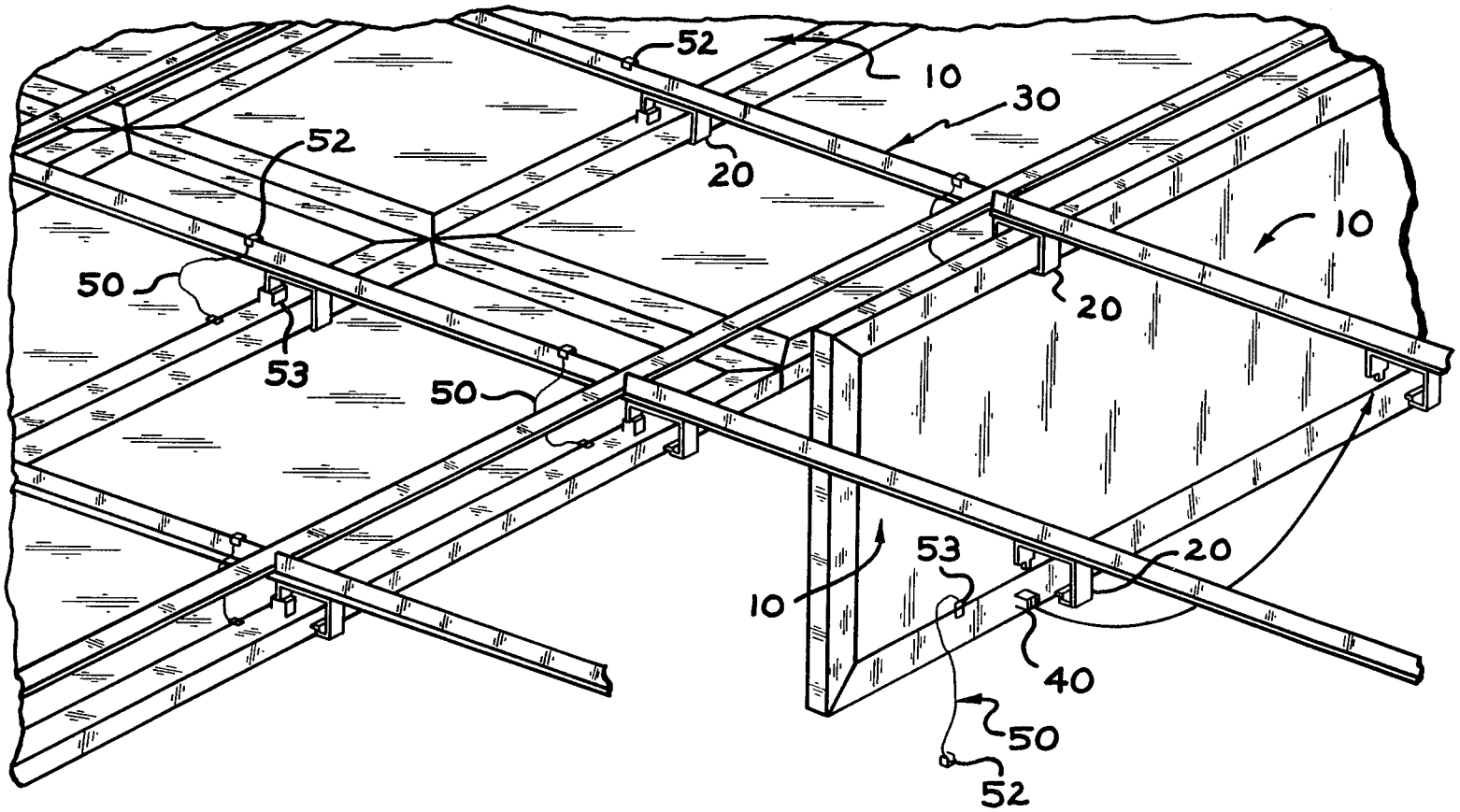
FIG. 1 is an overall view of a panel support system of the present invention showing panels supported by brackets mounted on a conventional "T" grid support system and illustrating how a panel is hung prior to being swung into installed position.

Referring to the drawings in greater detail, FIG. 1 illustrates a series of panels 10 mounted in side-by-side and end-for-end relationship supported by brackets 20 which in turn are mounted on a conventional grid system of "T" shaped members. Panels are decorative ceiling panels provided with an edge frame 11 made of material such as an extruded aluminum which lends itself to contouring to accomodate the base material for the panel, such as glass fiberboard material is made up of phenolic bonded glass fibers having a density of 6½ pounds or more which provides the rigidity necessary to act as a body for the panel. FIG. 1 also illustrates a panel hung by an edge from brackets 20 which engage one side of the panel frame 11 to permit the panel to be swung into engagement with an oppositely positioned bracket 20 for support of the opposite side of the panel in side-by-side relation with other panels of the system. After installation in horizontal position in the system, a safety strand or chain 50 such as a beaded chain which limits drop of one edge of the panel can be installed to prevent free swinging drop of the one edge of the panel.

Figure 2:
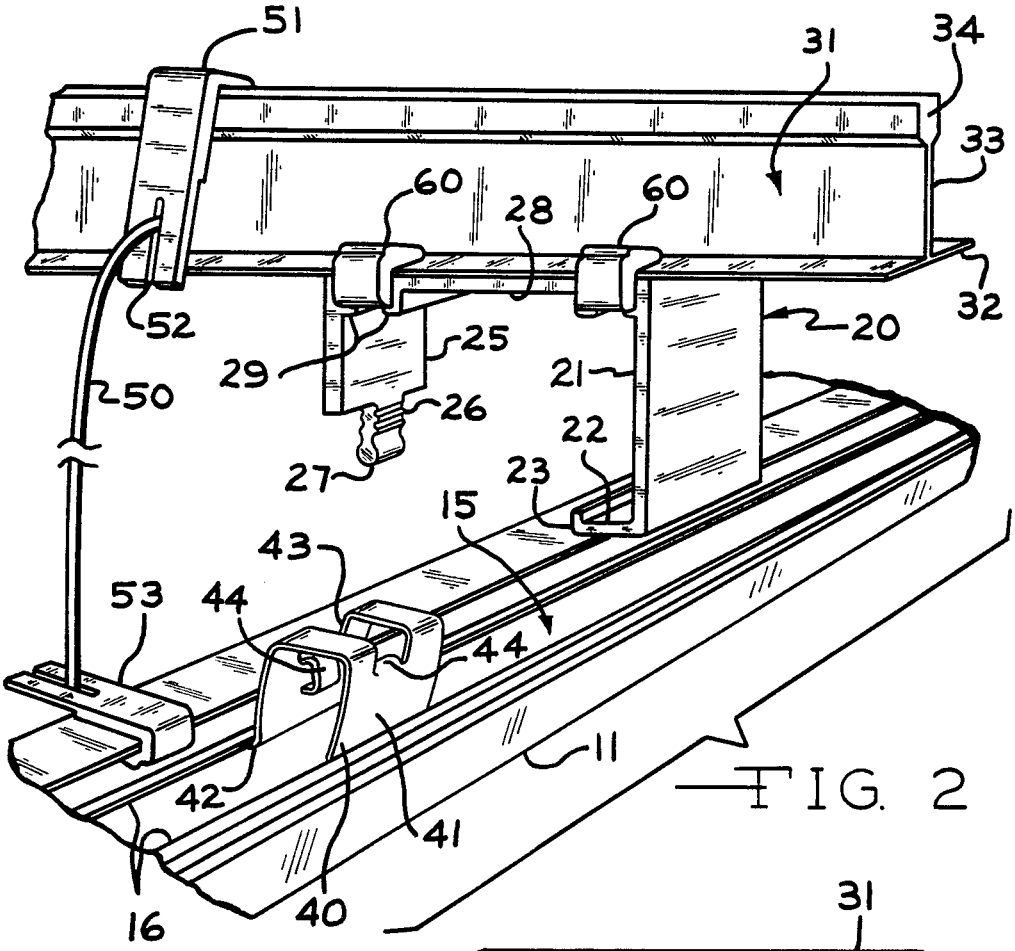
FIG. 2 shows a support bracket mounted on the "T" grid member of the system in FIG. 1 and a portion of a panel having a clip secured to the panel frame aligned for engagement with one leg of the bracket.

FIG. 2 illustrates in greater detail the shape of the parts of the system including the longitudinal members 31 of the overall support system 30. The members 31 as illustrated are conventional longitudinal "T" shaped members having a flange 32, a web 33 and a rail-like top 34. The members 31 forming a grid system overlying the dwelling space in which the panels are installed are supported conventionally in their overlying grid relation by cables, rods, wall members or the like, not shown.

Figure 3:
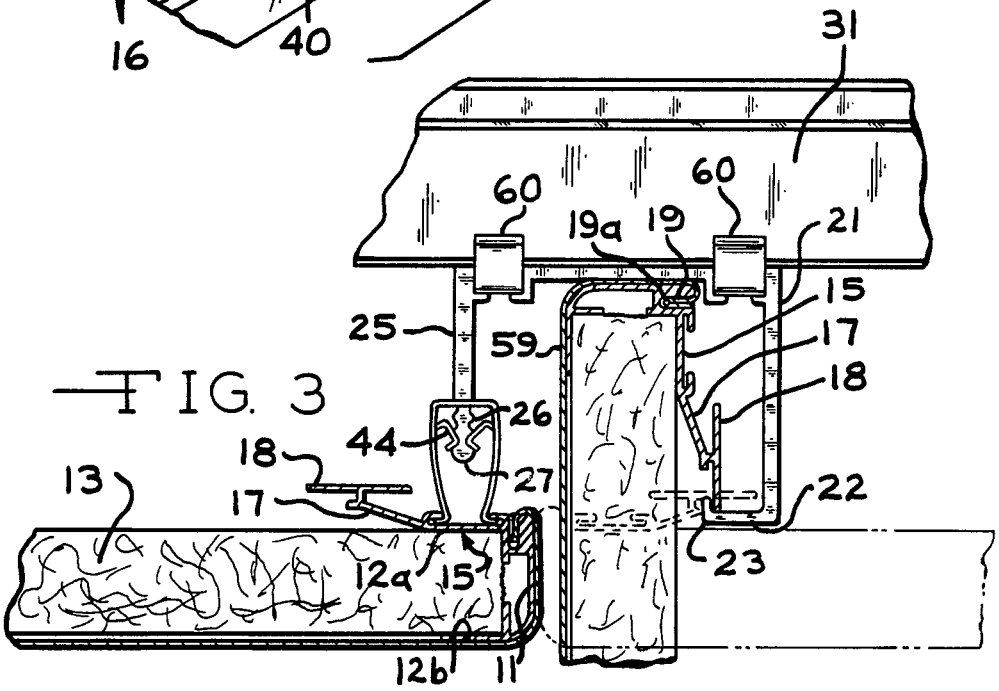
FIG. 3 shows edge portions of two adjacent panels supported according to the system of the invention with one panel installed and an adjacent panel hung on the bracket ready to be swung into installed position in an adjacent row of panels of the ceiling.

The cross sectional shape of the frame 11 of each of the panels 10 may be seen more clearly in FIG. 3 which shows an edge of the body material 13 overlapped by spaced top and bottom sides or flanges **12*a* and 12*b* respectively of the frame which form a channel 14 therebetween permitting ready placement of the frame member over an edge of the body 13 of the panel. One such frame member is mounted on each of the four edges of a panel and is secured in unitized relation with abutting members by right angular fastening members at the corners of the frame 11**.

A recessed longitudinal track 15 for holding support clips 40 on a panel is formed by opposing parallel retaining sides 16 on the top of flange **12*a* of the frame. In addition a web 17 extending laterally upward from the inner edge of the frame flange 12*a* provides a base for support of an overlying mounting flange 18 spaced over a marginal region of the body 13 of the panel adjacent the frame channel 14**.

The clips 40 are made of spring steel in a "U" shape to permit their being compressed and released for positionable interengagement with the retainers 16 of a track 15 of a panel frame 11. Each clip has a pair of opposing bent over detents 44 formed of a cutout portion 43 of its bridging section. The clip detents 44 are made to secureably interengage the tip of a serrated tongue of a mounted bracket leg 25 to support the side of a panel 10 on which the clip is mounted as may be seen in FIG. 3.

FIG. 3 also illustrates the manner in which a framed panel is hung vertically by the edge of its frame flange 18 from the lateral projecting portion 22 of a bracket leg 21 ready for the panel to be swung into its installed horizontal position as shown in dotted lines.

The panel 10 can be provided a decorative face covering 59, such as of cloth or plastic film, which is mounted over the panel face by securement of edges of the facing in a bead groove 19 with a separate longitudinal cord-like member **19*a*** such as of resinous material.

The bracket 20 as shown is an inverted generally "U" shaped member with one downwardly extending leg 21 having the general shape of a hook formed by a lateral projecting portion 22 and an upwardly extending lip 23. The other downwardly extending leg 25 has a serrated tongue 26 with a tip portion 27 shaped to extend into interlocking relation with a clip 40 slideably mounted in a track 15 of the panel frame 11.

The bracket 20 which is made of rigid material such as aluminum is slideably secured in mounted relation on the "T" member 31 by a pair of metal bands 60 also of material such as aluminum each having one end performed to engage one edge of the flange 32 in overlapping secured relation. The other end, after passage through a channel formed by a pair of retainers 29, is bent to overlap the other edge of the flange 32. Bands 60 are so passed through each of a pair of spaced channels formed by retainers 29 on the inside body portion 28 of the bracket adjacent each of the legs 21 and 25 to provide a stable slideable mounted relation of the bracket on the "T" member 31.

The spacing and relative lengths of the bracket legs 21 and 25 are such in relation to the frame configuration that when a panel 10 is hung by the flange 18 of its frame 11, it will have sufficient clearance with the adjacent already installed ceiling panel that its bottom frame edge, which is rounded, will closely clear the top edge of the adjacent installed panel to provide a close adjacency with an apparent abutting relation of the installed side-by-side panels.

When an installed panel is to be opened on one side for access to the plenum space or for removal of the panel, such as for access to overhead utilities, a thin rod with a lateral bend at one end is inserted upwardly in between the side-by-side panels to engage the top of the frame 11 close to clip 44. The engaged portion of the frame is drawn downwardly with a forceful jerk to release the clip 41 from the bracket leg 25, thereby releasing the portion of the panel which it supports. Any remaining clip 44 supporting the panel edge are correspondingly released to permit the panel edge to be suwng open about the opposite frame edge of the panel as a hinge. If the released edge has an optional connecting safety chain 50 installed having a rail hook 52 secured to the overlying "T" grid structure and a clip or hook 53 engaging the flange 18 of the panel frame, the panel edge will be allowed to drop only the safe distance determined by the chain length. Thereupon, the chain flange hook 53 may be disengaged to allow the panel to drop to a vertical hanging position from which it can be readily removed by being lifted from its hooked support on the brackets 20.

Figure 4:
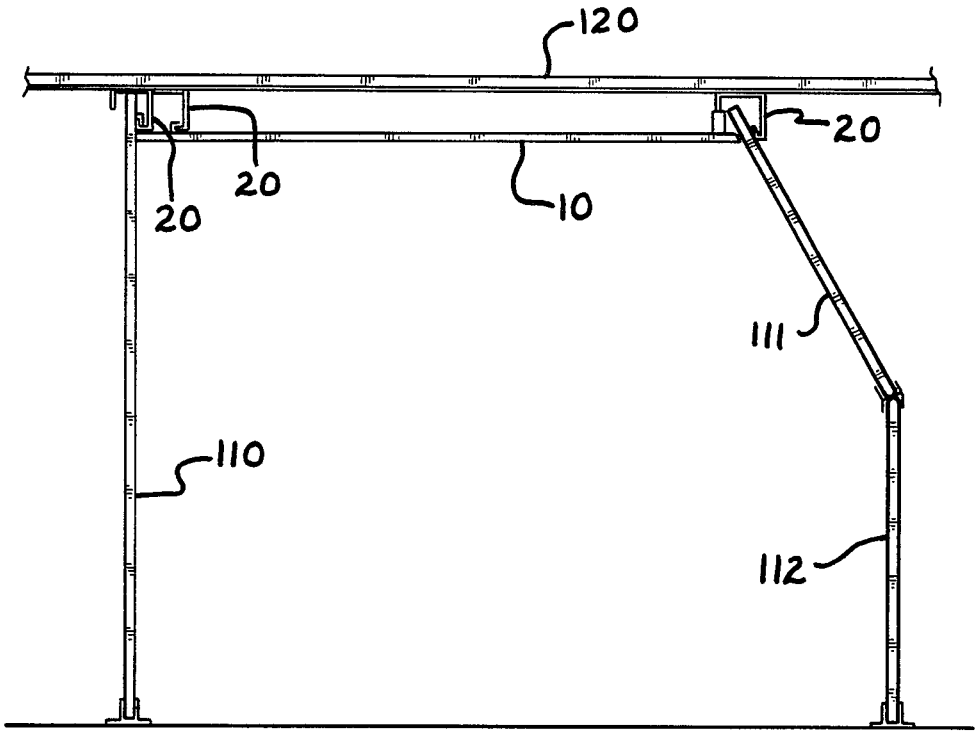
FIG. 4 shows the manner in which the invention lends itself to support of frame members in vertical and angular positions as room divider members in addition to their support of panels as ceiling members.

The support system lends itself to installation of panels vertically as room forming members or dividers as shown in FIG. 4 wherein a panel 110 is shown schematically hung vertically from ceiling to floor from brackets 20. The panels may also be installed at an angle to horizontal such as by hanging a panel 111 by brackets 20 in angular relation extending from the ceiling to the top edge of a room divider 112 which extends upwardly from the floor of the room. The brackets 20 mounted on the overlying structure 120 can then also serve the dual purpose of supporting ceiling panels 10 between the vertically and angularly oriented panels as shown in FIG. 4. Utility boxes and fixtures can also be supported in the system by the brackets.

A further feature of the invention is its adaptability to use of brackets having legs of longer, shorter or of adjustable length to permit support of panels in any of a desired distances below the structure on which the brackets are mounted. The bracket configuration may be varied in appearance just so long as one side provides a member which interengages with one side of a panel for support of the panel and another spaced member provides a disengageable hanging support of a panel about which the panel can be swung. The brackets might also be formed as part of the grid system. Further, the support structure itself it will be recognized is not limited to being made of inverted T-members but may be any of a number of different support members including angle shaped members and C-shaped members. Still further the brackets are not limited to being suspended in a grid system alone, however, but in some cases, where a ceiling is level, may be secured directly to the existing ceiling with screws or anchor members where the ceiling is of concrete or like material. The bracket may be made slideably positionable in such cases by provision of a slot in the body of the bracket.

In view of the foregoing it will be understood that many variations of the arrangement of the invention can be provided within the broad scope of principles embodied therein. Thus, while particular preferred embodiments of the invention have been shown and described, it is intended by the appended claims to cover all such modifications which fall within the true spirit and scope of the invention.

I claim:

1. In combination in a panel support system framed panels each having a frame about the panel media, an inwardly projecting overlying support ledge portion for support of at least one side on each such panel, a bracket securable to an overlying support structure, such bracket having at least one leg shaped with a laterally projecting portion having an upwardly extending component at its end for engagement in underlying relation with the ledge portion of a frame of a panel for hanging support of said panel from above said panel whereby the panel can be supported at said one side of the panel by two or more brackets in any of a number of orientations of the panel from vertical to horizontal.

2. In a paneled ceiling system comprising in combination framed panels each having a frame about the panel media, said frame including a support ledge projecting inwardly above the top of the frame at least at one side of the panel, panel support brackets secureable to an overlying support structure, each of said brackets having two side-by-side legs, one of said legs having a laterally inward projecting portion with an upwardly extending component at its end for engagement with the ledge portion of a first panel of said system to provide a hanging support therefor from above the panel, the other of said bracket legs providing an end shaped for interlocking supporting engagement with a panel securing clip of a panel adjacent to said first panel.

3. A ceiling system incorporating panel support brackets as set forth in claim 2 wherein the overlying support structure comprises a grid system of longitudinal cross members supported from a superstructure and each of said brackets is provided with retainer channels and clamp bars, each of the clamp bars being passed through one of the channels and bent in slideable secured relation about the sides of a support grid cross member to permit positioning of said bracket on said grid member for alignment and supporting engagement of panels in the system.

4. A ceiling system incorporating panel support brackets as set forth in claim 2 wherein the legs of each bracket are spaced apart a sufficient distance to permit hanging therebetween of an edge of a panel by its support ledge from the one leg but sufficiently close to effect close spaced support of an edge of an adjacent panel from said other leg and a securing clip secured to the top of said edge of the adjacent panel with which the other leg of said bracket makes interlocking engagement to provide support for the adjacent panel.

5. A ceiling system as set forth in claim 4 wherein the frames of panels have a track along at least the side opposite said securing ledge for holding securing clips in slideable relation therewith whereby each clip held by a track for securement of a framed panel is positionable for engagement with an interlocking leg of a bracket to provide support for the respective panel frame with which the clip is associated.

6. A ceiling system as set forth in claim 5 wherein at least two brackets are positioned in spaced relation along one side of a panel to provide support for the panel from above in hung relation from an overhanging ledge and another bracket is positioned along the opposite side of the panel to support the panel by interlocked relation of a clip thereon with an interlocking leg of the other bracket.

7. The method of installing a panel in a ceiling system as set out in claim 6 wherein the panel is first hung generally vertically from one side on hooked legs of two or more brackets, then moving the opposite side of the panel upward pivotally about said one side into interlocked relation with the interlocking leg of the other bracket by way of a securing clip positioned at the opposite side of the panel.

* * * * *